US011590390B2

(12) United States Patent
Allen

(10) Patent No.: US 11,590,390 B2
(45) Date of Patent: Feb. 28, 2023

(54) MODULAR EXERCISE SYSTEM

(71) Applicant: Daniel Allen, North Little Rock, AR (US)

(72) Inventor: Daniel Allen, North Little Rock, AR (US)

( * ) Notice: Subject to any disclaimer, the term of this patent is extended or adjusted under 35 U.S.C. 154(b) by 260 days.

(21) Appl. No.: 17/062,274

(22) Filed: Oct. 2, 2020

(65) Prior Publication Data

US 2021/0101050 A1 Apr. 8, 2021

Related U.S. Application Data

(60) Provisional application No. 62/910,036, filed on Oct. 3, 2019.

(51) Int. Cl.
*A63B 23/04* (2006.01)
*A63B 21/00* (2006.01)
(Continued)

(52) U.S. Cl.
CPC ..... *A63B 23/0488* (2013.01); *A61H 1/02* (2013.01); *A61H 2001/0248* (2013.01);
(Continued)

(58) Field of Classification Search
CPC . A63B 21/40; A63B 21/4001; A63B 21/4011; A63B 21/4013; A63B 21/4015; A63B 21/4017; A63B 21/4019; A63B 21/4021; A63B 21/4033; A63B 21/4034; A63B 21/4035; A63B 21/4045; A63B 21/00178; A63B 21/00185; A63B 22/20; A63B 20/201; A63B 2022/185; A63B 23/006; A63B 23/08; A63B 23/035; A63B 23/03516; A63B 23/03508; A63B 23/0355; A63B 23/03558; A63B 23/04; A63B 23/0405; A63B 23/4017; A63B 23/047; A63B 23/0482; A63B 23/0488; A63B 23/12; A63B 23/1209; A63B 23/1236; A63B 23/1245; A63B 23/1254; A63B 23/1272; A63B 23/1281; A63B 69/0057; A63B 69/0062; A63B 2208/0295; A63B 2210/50; A63B 2225/09; A61H 1/02; A61H 1/0237; A61H 1/024; A61H 1/0244; A61H 1/0255; A61H 1/0259; A61H 2001/0248; A61H 2201/1284; A61H 2201/1664; A61H 2203/0406; A61H 2203/0412; Y10T 403/7005; Y10T 403/7007;
(Continued)

(56) References Cited

U.S. PATENT DOCUMENTS 4,619,454 A * 10/1986 Walton ..... A63B 21/0552 482/128
5,328,427 A * 7/1994 Sleamaker ..... A63B 69/0022 482/110

(Continued)

*Primary Examiner* — Gary D Urbiel Goldner

(57) ABSTRACT

The present invention is a modular exercise system made up of two handles, a segmented track, and two or more sliding carriages. The invention allows a user to safely and incrementally practice front and side split exercises by providing specific and adjustable stability and support. The invention can be extended to accommodate taller users and can also be fully disassembled and packed into a compact travelling configuration.

6 Claims, 7 Drawing Sheets

(51) Int. Cl.
*A63B 23/035* (2006.01)
*A63B 23/00* (2006.01)
*A61H 1/02* (2006.01)

(52) U.S. Cl.
CPC ..... *A61H 2201/0107* (2013.01); *A61H 2201/0157* (2013.01); *A61H 2201/0161* (2013.01); *A61H 2201/1284* (2013.01); *A61H 2201/164* (2013.01); *A61H 2201/1664* (2013.01); *A63B 21/00178* (2013.01); *A63B 21/00185* (2013.01); *A63B 21/4034* (2015.10); *A63B 21/4035* (2015.10); *A63B 21/4039* (2015.10); *A63B 21/4045* (2015.10); *A63B 23/03516* (2013.01); *A63B 2023/006* (2013.01); *A63B 2210/50* (2013.01); *A63B 2225/09* (2013.01)

(58) Field of Classification Search
CPC ..... Y10T 403/32426; Y10T 403/32442; Y10T 403/32451
See application file for complete search history.

(56) References Cited

U.S. PATENT DOCUMENTS

| | | | | | |
|---|---|---|---|---|---|
| 5,624,356 | A * | 4/1997 | Roberts | A63B 22/0046 | 482/57 |
| 2012/0083396 | A1* | 4/2012 | Aquino | A63B 21/4035 | 482/131 |
| 2013/0274078 | A1* | 10/2013 | Andrews | A63B 21/4035 | 482/141 |
| 2014/0318550 | A1* | 10/2014 | Doci | A63B 23/0494 | 128/845 |

* cited by examiner

IGURE 7

MODULAR EXERCISE SYSTEM

CROSS REFERENCE TO RELATED APPLICATION

This application claims priority to U.S. Provisional Patent Application Ser. No. 62/910,036, filed Oct. 3, 2019 entitled: MODULAR EXERCISE SYSTEM, the contents of which are incorporated herein by reference.

TECHNICAL FIELD

The present invention relates to exercise equipment, including but not limited to stretching and flexibility aids, modular, versatile exercise equipment, and foldable, storable equipment.

BACKGROUND OF THE INVENTION

In athletics and fitness, a split, or the splits, is an activity in which a person assumes a physical position with their legs extended straight, in opposite directions and in-line with other, such that the angle formed between the legs is approximately 180 degrees. This exercise demonstrates and requires significant flexibility, in particular involving large muscles in the thigh. It is useful as a stretching exercise. There are generally two forms of splits: side splits in which the legs are extended laterally with respect to the torso, and front splits in which the legs are extended forward and rearward with respect to the torso. Splits require a level of flexibility not found in the general population and which generally require training to properly execute.

Modular equipment refers to an apparatus or a system of apparatuses which comprises multiple parts and which can be assembled or rearranged in order to provide additional utility or to expand existing utility, such as a set of weights which can be used to adjust a total weight being lifted, or a machine which, through reconfiguration, allows for the training of different muscle groups. Modular equipment can also refer to equipment which can be extended via modular components to accommodate users of different physical dimensions.

No specialized equipment exists which aids a user in practicing front and side splits safely and incrementally. What is desired is such a training aid for performing both front and side splits which is modular and transportable.

SUMMARY OF THE INVENTION

The present invention is a system of apparatuses which work together to provide stability in the form of constraints on user bodily position and motion such that said user can safely and incrementally practice performing the flexibility exercise known as a split or the splits. Said system comprises a main track, said main track comprising a plurality of interlocking track segments, left and right handle components, said components being identical except for their positioning which is left and right of said main track, respectively, and a plurality of sliding carriages which are dimensioned to be coupled to said main track and which comprise contoured pads which act as user contact points, receiving, for example, a knee or foot, and which further comprise locking features. The components of the system can further be collated into a compact travelling configuration for easy movement or storage.

To those skilled in the art to which this invention relates, many changes in construction and widely differing embodiments and applications of the invention will suggest themselves without departing from the scope of the invention as defined herein. The disclosures and the descriptions herein are purely illustrative and are not intended to be in any sense limiting.

BRIEF DESCRIPTION OF THE DRAWINGS

For a better understanding of the present invention including the features, advantages and specific embodiments, reference is made to the following detailed description along with accompanying Figures, in which.

DETAILED DESCRIPTION OF A PREFERRED EMBODIMENT

While the making and using of the disclosed embodiments of the present invention is discussed in detail below, it should be appreciated that the present invention provides many applicable inventive concepts which can be embodied in a wide variety of specific contexts. Some features of the preferred embodiments shown and discussed may be simplified or exaggerated for illustrating the principles of the invention.

The present invention is a system of apparatuses which work together to provide stability in the form of constraints on user bodily position and motion such that said user can safely and incrementally practice performing the flexibility exercise known as a split or the splits.

Figure 1:
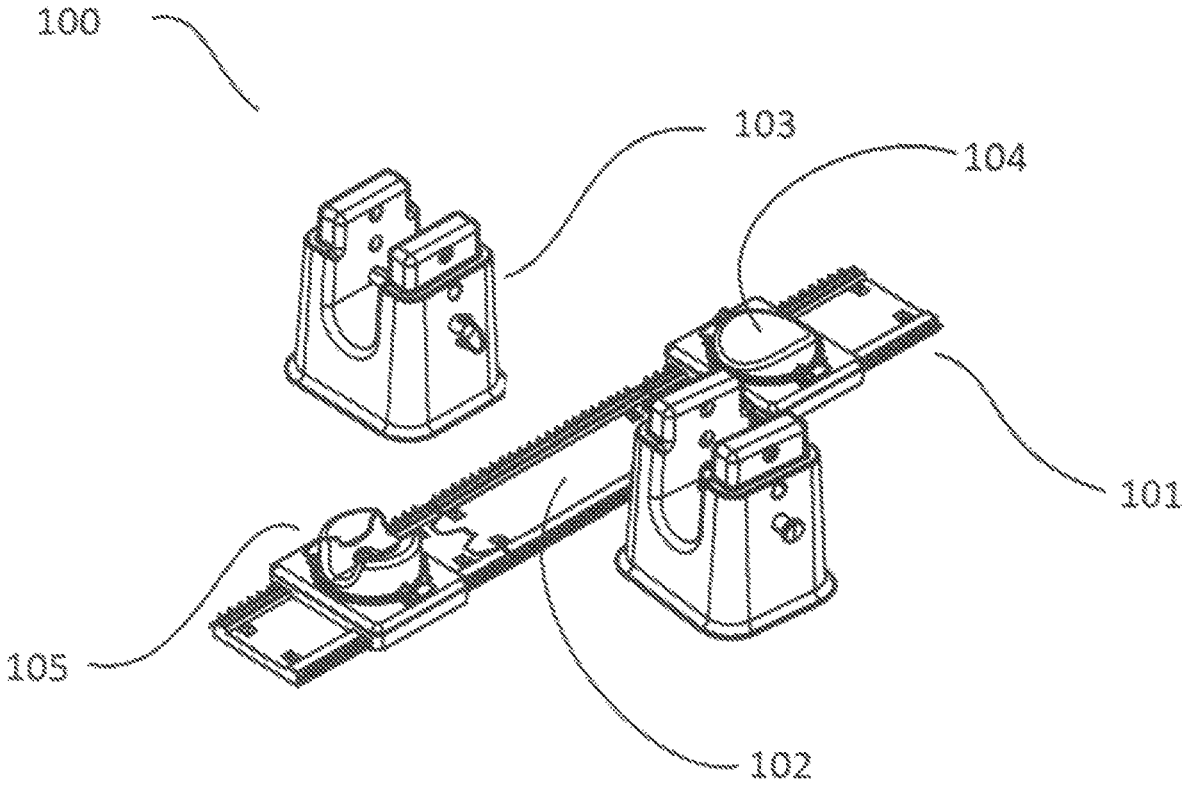
FIG. 1 is a top perspective view of the assembled components of the exercise system in an embodiment of the present invention.
Figure 2:
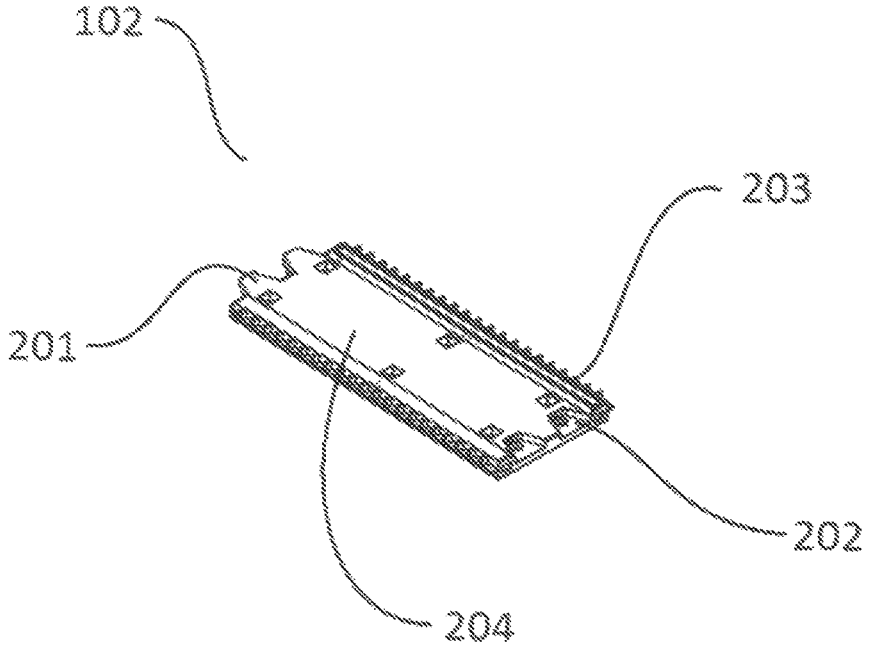
FIG. 2 is a top perspective view of a track segment in an embodiment of the present invention.
Figure 3:
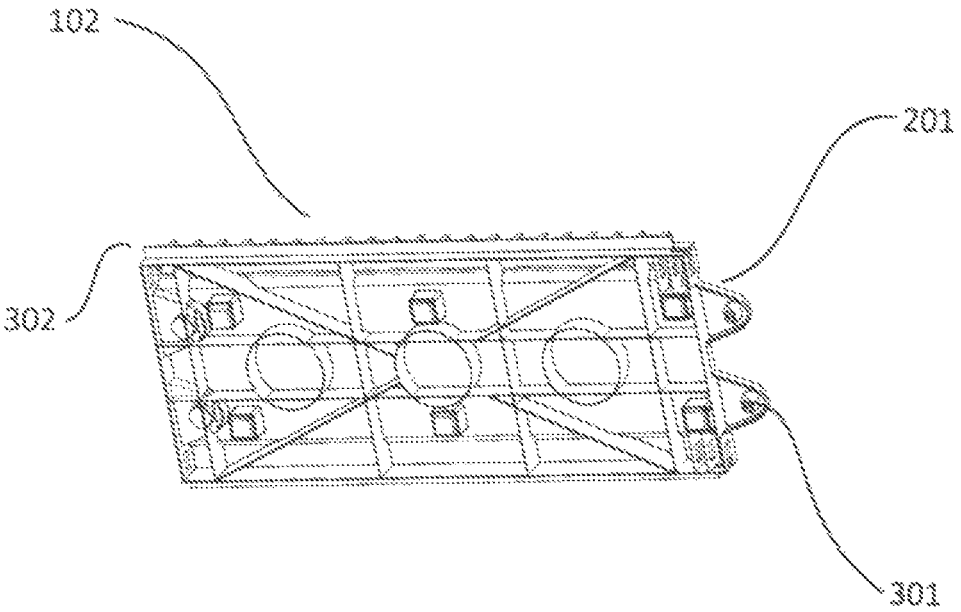
FIG. 3 is a bottom perspective view of a track segment in an embodiment of the present invention.
Figure 4:
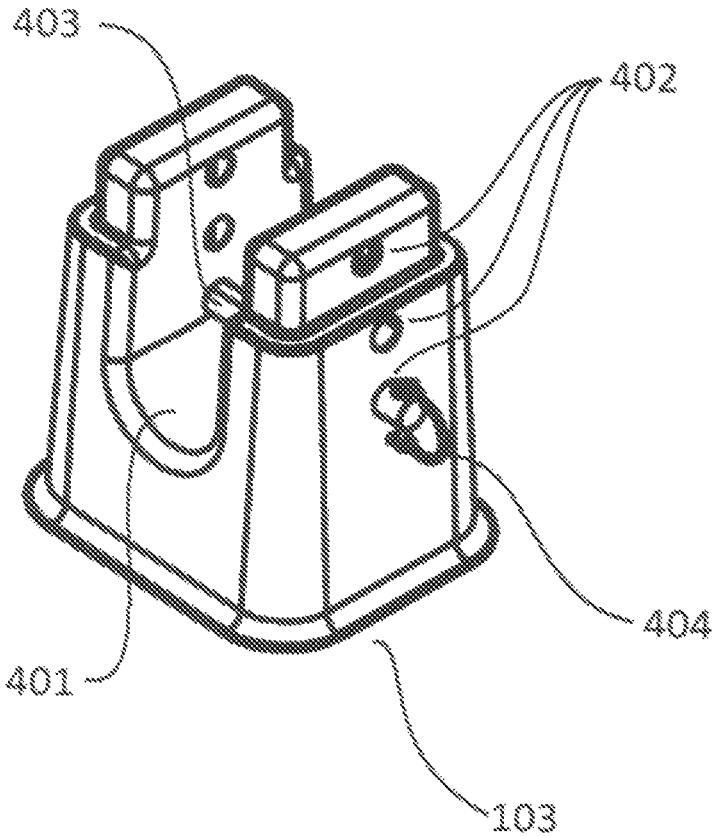
FIG. 4 is a top perspective view of a disassembled handle component in an embodiment of the present invention.

FIG. 1 discloses one embodiment of the present invention in which a modular exercise system 100 comprises a main track 101 made up of track segments 102, left and right handle components 103, and two or more sliding carriage assemblies 104 and 105, each of said sliding carriage assemblies comprising an associated contoured pad of type A or type B respectively, Said main track 101 comprises a plurality of identical interlocking track segments 102. Referring to FIGS. 2 and 3, each of said track segments is dimensioned as a rectangular strip much shorter than it is wide and long, and longer than it is wide, each of said track segments comprising one or more interlocking tabs 201 extending longitudinally in a forward-, or along-track direction, said tabs having locking elements such as pegs 301 extending downwards therefrom, each of said track segments further comprising corresponding interlocking receptor segments 202 being cut-outs from the rearward segment of each of said track segments, said cut-outs being dimensioned to receive the tabs 201 and corresponding pegs 301 of an adjacent track segment, said adjacent track segments being thus securely fastened to each other so that there is no relative motion in the lateral and longitudinal directions and so that said track segments can be easily decoupled by lifting the rearward track segment vertically, said adjacent track segments further having top surfaces which are approximately flush with each other; each of said track segments further comprises, on each of its lateral faces, a toothed segment 203, said toothed segment comprising in one embodiment a plurality of rectangular tabs or teeth oriented vertically and extending outwards laterally from the upper half of each of said lateral faces of said track segment; each of said track segments further comprising a shallow recessed groove 204 on its upper surface which acts as a guide for attached sliding carriage assemblies 104, 105, said groove extending through the front and rear faces of said track segment and thus allowing for the movement of said carriage assemblies between adjacent attached track segments, in other words movement along said main track, while disallowing lateral movement of the same. Said track segments further comprise side-fins 302 extending outward from each lateral side along a line at mid-height of said track segment, said side-fins being oriented horizontally and joined to the bottom of each tooth and corresponding to guiding elements in each sliding carriage assembly.

Said left and right handle components 103 are identical, each of said handle components comprising an approximately rectangular prism shape oriented vertically such that one face is flush with the ground, this being defined as the bottom face, the top face having a removed section in the shape of a deep notch or groove 401 extending through the front and rear faces of said rectangular prism and extending downward from the top face approximately half the height of said prism, said removed section being dimensioned for receiving a user's hand, each of said handle components further comprising a plurality of through-holes 402 which extend from the left side of said prism through said removed section through the right side such that an unobstructed cylindrical hole extends laterally through said handle component, two or more of these through-holes being positioned so that they are vertically separated at regular intervals, each of these through holes being dimensioned to receive a grip bar 403, said grip bar being a cylinder which is placed through said through holes and which extends entirely through said handle component, said grip bar having near one end lateral through-holes drilled through which a lynch-pin 404 or other locking mechanism is placed, said grip bar comprising on its opposite end a segment of larger radius which cannot fit through the through-holes in said handle component, said grip bar being thus secured once inserted and locked in place; in one embodiment, each of said handle components comprises on its bottom surface several rectangular slots dimensioned for receiving track segments in a stacked configuration.

Referring to FIGS. 5 through 8, each of said sliding carriage assemblies 104, 105 comprises a housing 500, a contoured pad A 501 or contoured pad B 601, and a locking mechanism; said housing is dimensioned as a squat rectangular prism comprising two elements; the first element is an upper plate 700 and the second is a lower case 701; said upper plate 700 comprising a circular opening 704 oriented vertically and extending through the midpoint of said upper plate, said circular opening corresponding to and being dimensioned to receive the rotating element 702 of said locking mechanism; said lower case comprises a groove 502 dimensioned to receive a track segment, said groove extending through the front and rear faces of said sliding carriage, said groove consisting of a central guide 503 corresponding to the upper groove in each track segment and two wrap-around guides 504 corresponding to the side-fins 302 on each track segment which serve to constrain each sliding carriage assembly vertically so that said sliding carriages cannot be lifted off said main track and must be slid on from a free track end; said contoured pad A 501 or B 601 is set in a corresponding upper circular inset 703 of said locking mechanism rotating element 702 which is itself set in the circular opening 704 in said sliding carriage assembly housing upper plate 700; the desired contoured pad A 501 or B 601 is freely rotatable about an axis coaxial to the longitudinal axes of said contoured pad, said circular opening 704, and said rotating element 702 of the locking mechanism; said contoured pad is further able to rotate about its longitudinal axis independently of the rotation of said rotating element 702 and vice versa.

Said locking mechanism comprises a rotating element 702 coupled via curved grooves 705 to two identical sliding plates 706, said plates comprising guide pegs 801 extending through said curved grooves, said plates further comprising linear grooves 707 dimensioned to accept corresponding guide pegs 708 extending upward from said housing lower case, said plates 706 being thereby constrained such that they move laterally outward or inward as a pair with the clockwise or counter-clockwise rotation, respectively, of said rotating element 702, said rotation causing the sliding plate guide pegs 801 and therefore the sliding plates 706 to move laterally outward or inward, said sliding plates each further comprising a plurality of teeth 709 corresponding to the toothed segments 203 on each track segment; said sliding plate teeth interlocking with said track segment teeth when said sliding plates are moved laterally inward, or engaged, by said rotating element, said sliding carriage assembly being thereby fixed in position with respect to said main track. Said rotating element 702 further comprises a pair of tabs 505 extending first laterally outwards and then upwards from opposite sides of the upper segment of said rotating element, such that said tabs are resting on the upper surface of said housing upper case 700; rotation of said rotating element is actuated by manipulating said tabs.

Figure 5:
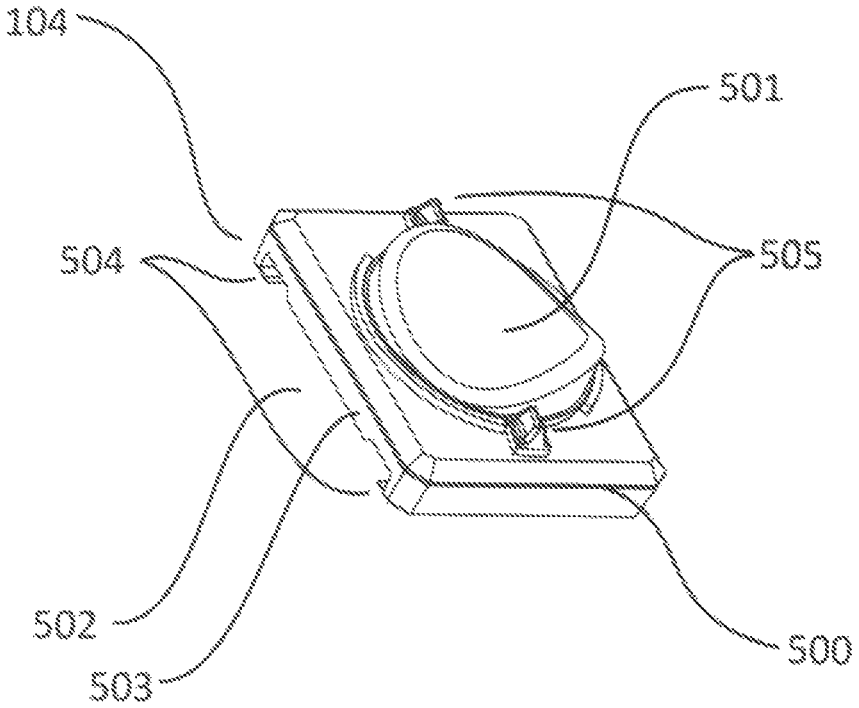
FIG. 5 is a top perspective view of an assembled sliding carriage assembly comprising a contoured pad A in an embodiment of the present invention.
Figure 7:
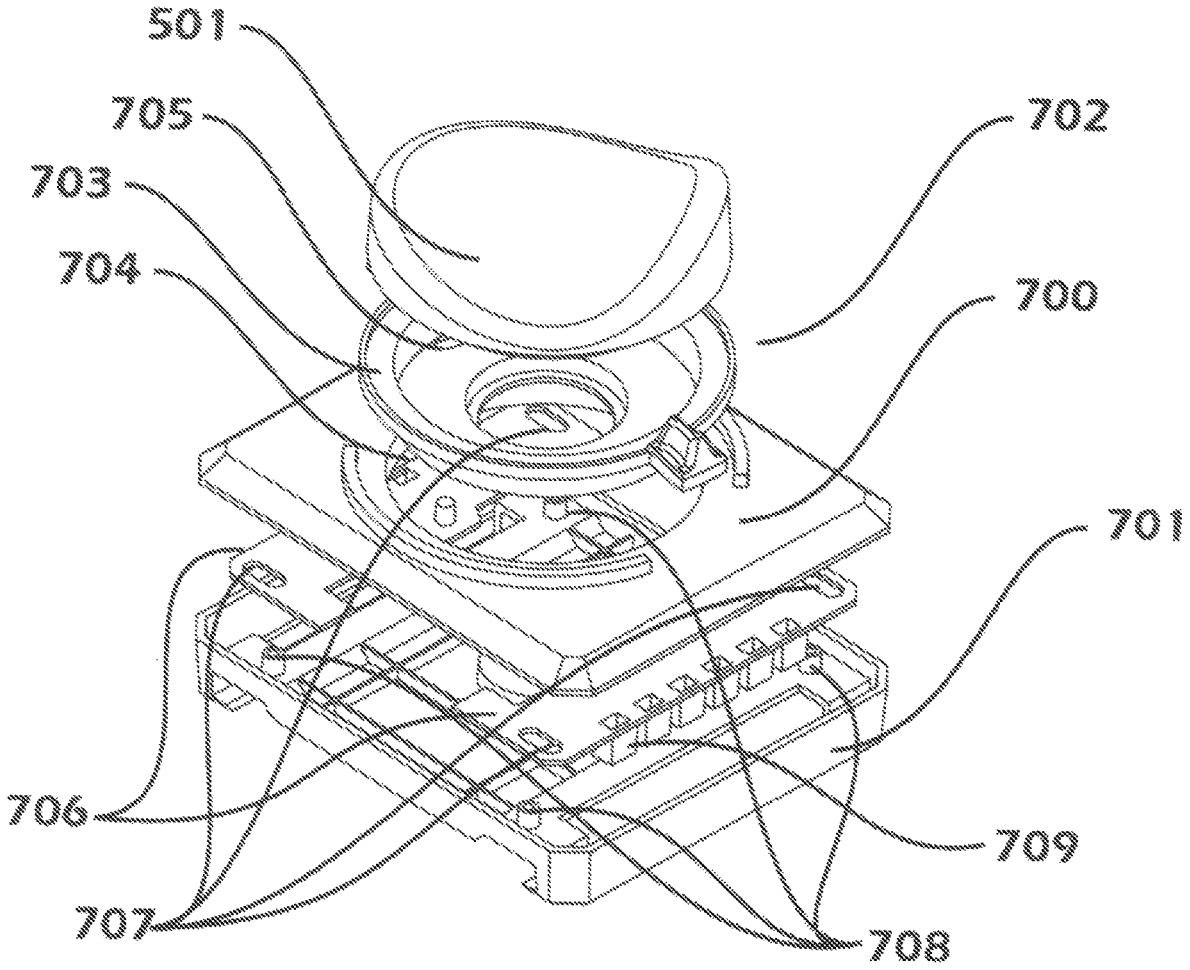
FIG. 7 is a top perspective view of a disassembled sliding carriage A component in an embodiment of the present invention.
Figure 8:
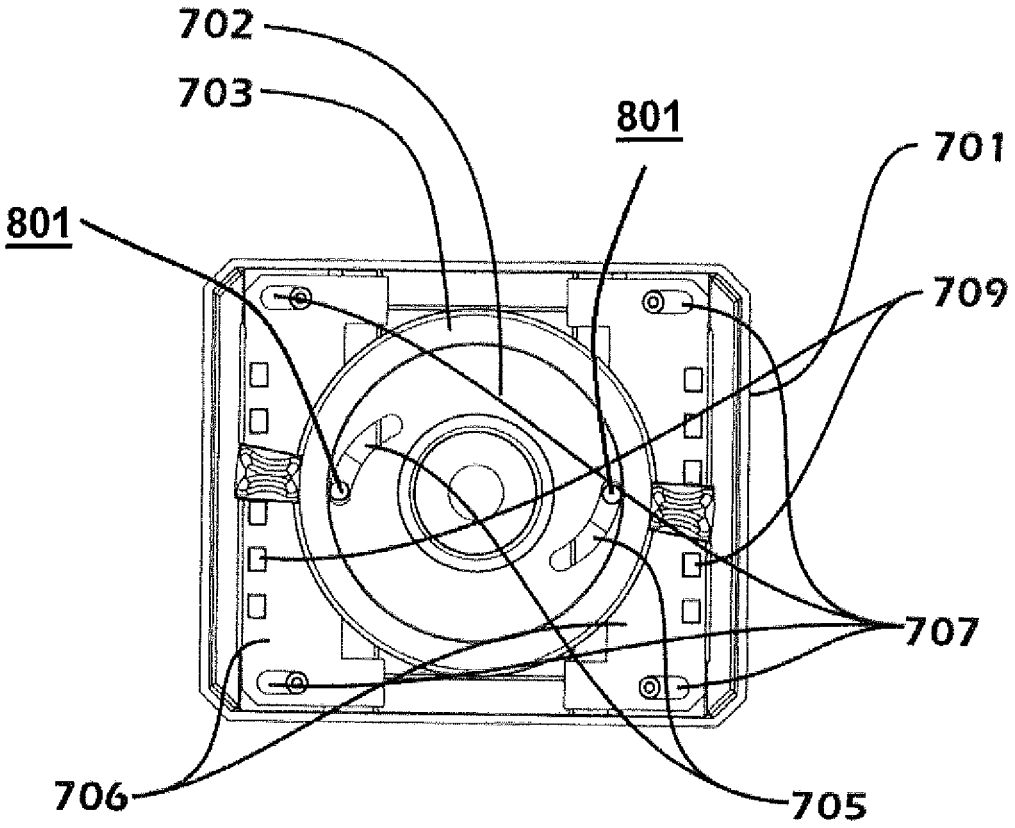
FIG. 8 is a top planform view of an assembled sliding carriage component with the top plate and knee pad removed showing the locking mechanism in an embodiment of the present invention.

In an embodiment, several different contoured pads can be interchanged, said interchangeable pads having differently shaped concave surfaces to accommodate, for example, different limbs/extremities or different limb sizes more comfortably or effectively. Contoured pad A 501 is made of a semi-rigid soft material like a foam and is dimensioned as a squat vertically-oriented cylinder having a smooth concave depression in its upper surface; in one embodiment, said concave depression is in the shape of a wide, shallow U opening upwards and being skewed to one side such that one leg is long and shallow, and the other short and steep. Said contoured pad A rests in a circular inset 703 and is constrained by a raised edge or lip, said pad having a fixed position with respect to its associated sliding carriage but being allowed to rotate freely about its longitudinal axis. FIGS. 5 and 7 disclose rotatable contoured pads A that are adjustable dynamically to the position of the user's knee. In a further embodiment, said sliding carriage assemblies comprise an additional locking mechanism coupled to said contoured pads such that the contoured pad can be rotated to a specific position and locked into place. In the dynamic arrangement, the contoured pad A can be allowed to rotate with the desired amount of friction so that if the knee is outside of a parallel or co-axial alignment with either leg, the contoured pad A rotates to accommodate such mis-alignment.

Figure 6:
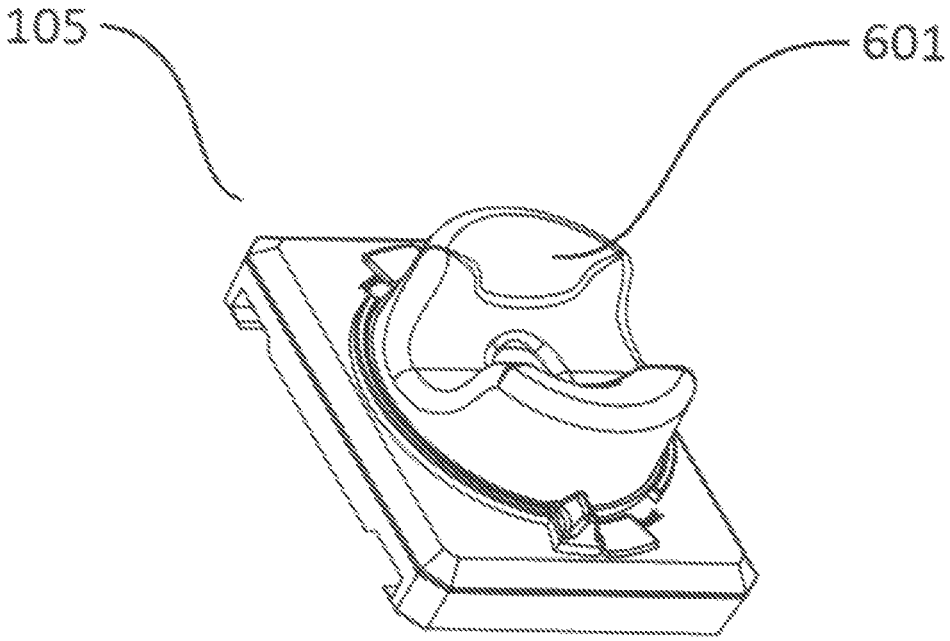
FIG. 6 is a top perspective view of an assembled sliding carriage assembly comprising a contoured pad B in an embodiment of the present invention.

Contoured pad B is dimensioned as a squat vertically-oriented cylinder having a stepped concave depression in its upper surface; in one embodiment, said concave depression is in the shape of a symmetrical U opening upwards and being taller than contoured pad A. Said contoured pad B further comprises a circular opening co-axial with said contoured pad B and having a diameter smaller than the diameter of contoured pad B, said circular opening being oriented vertically and extending downward through the center of said contoured pad B. Said contoured pad B rests in a circular hole and is constrained by a raised edge or lip, said pad having a fixed position with respect to its associated sliding carriage but being allowed to rotate freely about its longitudinal axis. In another embodiment, said pad can be fixed in a desired orientation. FIG. 6 discloses a rotatable contoured pad B that is adjustable dynamically. In a further embodiment, said sliding carriage assemblies comprise an additional locking mechanism coupled to said contoured pads such that the contoured pad can be rotated to a specific position and locked into place. In the dynamic arrangement, the contoured pad B can be allowed to rotate with the desired amount of friction so that the contoured pad B rotates to accommodate mis-alignment.

Figure 9:
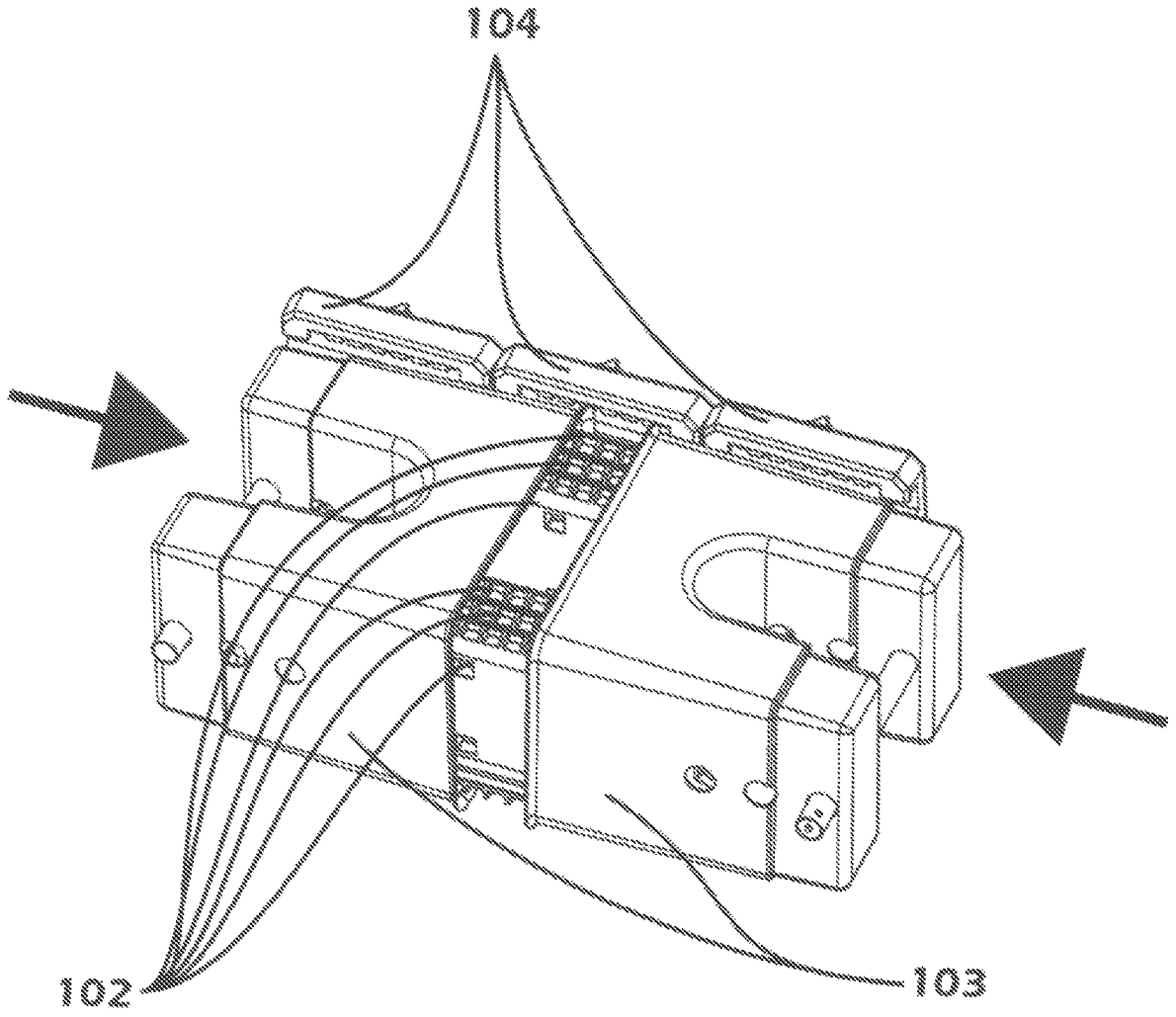
FIG. 9 is a top perspective view of the exercise system partially assembled for transport, in an embodiment of the present invention.
Figure 10:
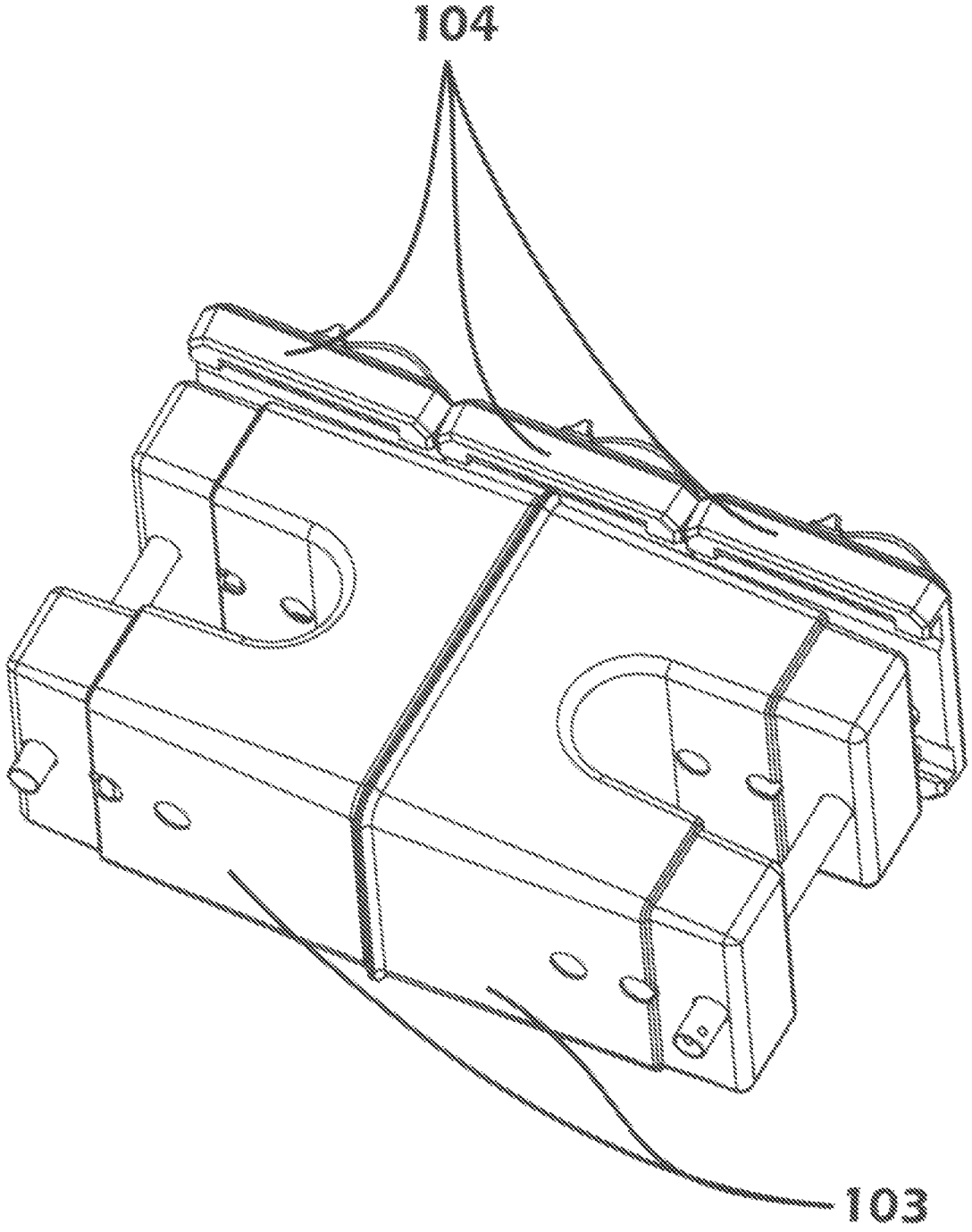
FIG. 10 is a top perspective view of the exercise system fully assembled for transport, in an embodiment of the present invention.

In an embodiment, the components of said system, namely the plurality of track segments 102, two sliding carriage assemblies 104 and/or 105, and two handle components 103, can be collated into a compact travelling or storage configuration. Referring to FIGS. 9 and 10, the track segments 204 are stacked and fitted into slots in the bottom surface of each handle component 103, said slots being dimensioned to receive said track segments 204 (within the system), said sliding carriages 104 being affixed to the top and bottom track segments in the stack, the entire assembly then being easily moved as a unit or placed in a carrying bag or similar.

The embodiments shown and described above are only exemplary. Even though numerous characteristics and advantages of the present invention have been set forth in the foregoing description, the disclosure is illustrative only and changes may be made within the principles of the invention to the full extent indicated by the broad general meaning of the terms used herein. Various alterations, modifications and substitutions can be made to the disclosed invention and the system that implements the present invention without departing in any way from the spirit and scope of the invention.

I claim:

1. A system, comprising:

a plurality of apparatuses configured to interoperate to provide stability for constraining bodily position and motion of a user so that said user can safely and incrementally practice performing a flexibility exercise known as a split or splits;

wherein said plurality of apparatuses comprises a main track element, one or more handhold elements, and one or more sliding carriage elements;

wherein said main track element comprises one or more identical track segments; and wherein said one or more identical track segments each have a structure selected from the group consisting of:

one or more interlocking tabs extending outward in an along-track direction of said one or more identical track segments, each of said one or more interlocking tabs comprising a peg extending downwards therefrom; said one or more identical track segments each further comprising receptor segments being cutouts from an end of said identical track segment opposite said one or more interlocking tabs, said cutouts being dimensioned to receive said one or more interlocking tabs and associated pegs of an adjacent identical track segment, said adjacent identical track segments being thus securely fastened to each other such that upper surfaces of said adjacent identical track segments are co-planar; and toothed sections extending outward from lateral sides of said one or more identical track segments, said toothed sections comprising a plurality of vertically-oriented rectangular teeth which correspond to locking elements on said one or more sliding carriage elements; each of said one or more identical track segments further comprising a shallow recessed groove set into the respective upper surface and side-fins extending outwards from the respective lateral sides, said shallow recessed groove and side-fins acting as guide elements for said one or more sliding carriage elements.

2. A system, comprising:

a plurality of apparatuses configured to interoperate to provide stability for constraining bodily position and motion of a user so that said user can safely and incrementally practice performing a flexibility exercise known as a split or splits;

wherein said plurality of apparatuses comprises a main track element, one or more handhold elements, and one or more sliding carriage elements;

wherein said main track element comprises one or more identical track segments;

wherein each of said one or more sliding carriage elements comprises a housing, a locking mechanism, and a contoured pad; and wherein said housing comprises a lower case and an upper plate; said lower case comprising a guide tab extending downwards from a lower surface of said lower case and corresponding to a guide groove in said one or more identical track segments, said guide tab and guide groove constraining a movement of said respective sliding carriage elements to along-track directions of said one or more identical track segments;

said lower case further comprising linear guide pegs extending upwards from an inner surface of said lower case corresponding to linear guide grooves of said locking mechanism; and said upper plate comprising a circular opening dimensioned to admit a rotating element of said locking mechanism.

3. The system of claim 2, wherein said rotating element is coupled via curved guide grooves and associated guide pegs extending from said rotating element to two identical sliding plate elements located on opposite sides of said rotating element, each of said identical sliding plates further comprising a pair of linear guide grooves of said linear guide grooves of said locking mechanism dimensioned to admit corresponding said linear guide pegs of said lower case;

said identical sliding plates being thereby constrained to move laterally outward or inward as a pair with clockwise or counter-clockwise rotation, respectively, of said rotating element;

said identical sliding plates further comprising a plurality of teeth corresponding to toothed sections of said one or more identical track segments such that said plurality of teeth and said toothed sections are enmeshed and the respective sliding carriage element is locked in a fixed position when said rotating element is rotated counter-clockwise; and said rotating element further comprising a pair of tabs positioned on opposite sides of a longitudinal axis of said rotating element, said pair of tabs being manipulatable by said user to actuate the rotation of said rotating element about said longitudinal axis.

4. The system of claim 3, wherein said rotating element further comprises an annular shelf set into an upper surface of said rotating element, said annular shelf having a raised lip around an outer edge of said annular shelf, said annular shelf being dimensioned to accept said contoured pad, said contoured pad being constrained in lateral motion but being allowed to rotate freely about a longitudinal axis of said contoured pad, the longitudinal axis of said contoured pad being coaxial with the longitudinal axis of said rotating element.

5. A system, comprising:

a plurality of apparatuses configured to interoperate to provide stability for constraining bodily position and motion of a user so that said user can safely and incrementally practice performing a flexibility exercise known as a split or splits;

wherein said plurality of apparatuses comprises a main track element, one or more handhold elements, and one or more sliding carriage elements;

wherein each of said one or more sliding carriage elements comprises a housing, a locking mechanism, and a contoured pad; and wherein said contoured pad is dimensioned as a squat vertically-oriented cylinder with a concave U-shaped depression in an upper surface of said contoured pad, said contoured pad being further dimensioned to sit in and on an annular shelf set into an upper surface of a rotating element of said locking mechanism such that said contoured pad is prevented from moving laterally but allowed to rotate freely about a longitudinal axis of said contoured pad, said concave U-shaped depression being further dimensioned to accept and support a knee of said user.

6. The system of claim 5 wherein said contoured pad is made of a semi-rigid or flexible foam material.

* * * * *